US006717529B1

(12) United States Patent
Belvin et al.

(10) Patent No.: US 6,717,529 B1
(45) Date of Patent: Apr. 6, 2004

(54) RADIO TELEMETRY SYSTEM AND METHOD

(75) Inventors: Stephen E. Belvin, Largo, FL (US); Donald R. Parker, Seminole, FL (US); Robert W. Pauley, Belleair, FL (US)

(73) Assignee: BelTech Systems Inc., Largo, FL (US)

( * ) Notice: Subject to any disclaimer, the term of this patent is extended or adjusted under 35 U.S.C. 154(b) by 575 days.

(21) Appl. No.: 09/671,077

(22) Filed: Sep. 27, 2000

Related U.S. Application Data

(60) Provisional application No. 60/163,219, filed on Nov. 2, 1999.

(51) Int. Cl.[7] ..... G08B 25/10

(52) U.S. Cl. ..... 340/870.16; 340/870.17

(58) Field of Search ..... 340/870.16, 870.17, 340/870.11, 870.02, 870.14, 539, 540, 3.2, 517; 205/725; 455/507

(56) References Cited

U.S. PATENT DOCUMENTS 558,274 A * 4/1896 Ben-Aissa et al. ..... 139/107
5,272,477 A * 12/1993 Tashima et al. ..... 340/870.16
5,461,365 A * 10/1995 Schlager et al. ..... 340/573.4

* cited by examiner

*Primary Examiner*—Michael Horabik
*Assistant Examiner*—Hung Dang

(57) ABSTRACT

A telemetry system is described including a remote unit having a remote input unit coupled to a remote transmit unit. The remote input unit receives one or more sensor output signals and produces a sensor status signal dependent upon the sensor output signals. The sensor status signal alternates between a first state and a second state, wherein an amount of time the sensor status signal remains in the first state is dependent upon one of the sensor output signals. An amount of time the sensor status signal remains in the second state may depend upon sensor output signals from other sensors. The remote transmit unit receives the sensor status signal and transmits a transmit signal each time the sensor status signal transitions between the first and second states. The transmit signal may be a frequency modulated radio frequency carrier signal including a status portion having direction information indicating a direction of the transition between the first and second states. The transmit signal may also have an identification portion including identification information uniquely identifying the remote unit. The telemetry system may also include a base unit coupled to receive the transmit signals transmitted by the remote transmit unit, wherein the base unit is configured to reproduce the sensor status signal from the transmit signals. The base unit may also produce a sensor status from the sensor status signal, and may display the sensor status.

28 Claims, 7 Drawing Sheets

RADIO TELEMETRY SYSTEM AND METHOD

RELATED APPLICATION

This application is a Continuation of Provisional Application No. 60/163,219 filed Nov. 2, 1999.

BACKGROUND OF THE INVENTION

1. Field of Invention

This invention relates to radio telemetry, and more particularly to systems and methods for transmitting sensor information to a user's location remote from the sensor.

2. Description of Related Art

A typical radio telemetry system employs one of several different modulation methods, and one of several different multiplexing techniques, in order to transmit information produced by multiple sensors to a user's location remote from the sensors. Well known methods of modulating a carrier frequency to convey information include amplitude modulation, frequency modulation, phase modulation, and pulse modulation. Well known multiplexing methods include frequency division multiplexing and time division multiplexing.

Known pulse modulation techniques include pulse amplitude modulation, pulse code modulation, pulse frequency modulation, and pulse width modulation. In pulse amplitude modulation (PAM), the amplitude of a pulse corresponds to that of a modulating waveform. In pulse code modulation, PAM pulses are sampled at regular intervals and quantized (i.e., assigned a digital value). In pulse frequency modulation, pulses of equal amplitude are generated at a rate determined by the amplitude of the modulating waveform. In pulse width modulation, pulses are generated at a regular rate, and the widths of the pulses are determined by the amplitude of the modulating waveform.

In the United States, the Federal Communications Commission (FCC) regulates radio communications. The FCC has set aside certain frequencies for the radio control (R/C) radio service. R/C is for one-way, short distance, non-voice radio service for: (i) allowing an operator to turn on or off a device at a remote location, or (ii) turning on or off an indicating device for the operator by a sensor at a remote location. The fact that there are no age or citizenship requirements to operate for an R/C unit, and license documents are neither required nor issued, makes R/C communications attractive.

Both regulatory and practical limitations bear upon the lengths of R/C communications. According to 47 C.F.R. 95.215 (R/C Rule 15), the lengths of R/C communications must be limited to "the minimum practical time." On the practical side, the lifetimes of batteries powering R/C transmitters decrease with increasing lengths of R/C communications.

It would thus be desirable to have a system and method for radio telemetry suited for R/C communications. The system and method would also preferably minimize the lengths of radio communications.

SUMMARY OF THE INVENTION

A telemetry system is described, including a remote unit having a remote input unit coupled to a remote transmit unit. The remote input unit receives one or more sensor output signals and produces a sensor status signal dependent upon the sensor output signals. The sensor status signal alternates between a first state and a second state, wherein an amount of time the sensor status signal remains in the first state is dependent upon one of the sensor output signals. The remote transmit unit receives the sensor status signal and transmits a transmit signal each time the sensor status signal transitions between the first and second states.

The sensor output signal used to determine the amount of time the sensor status signal remains in the first state may be an analog signal produced by a sensor (e.g., and analog sensor) in response to an input measurand (e.g., temperature, pressure, humidity, wind speed, wind direction, or a level of collected rain water).

The transmit signal may be a frequency modulated radio frequency carrier signal. In one embodiment, the transmit signal has a status portion including direction information indicating a direction of the transition between the first and second states (e.g., '1' for a transition from the second state to the first state, and '0' for a transition from the first state to the second state). The transmit signal may also have an identification portion including identification information uniquely identifying the remote unit.

The telemetry system may also include a base unit coupled to receive the transmit signals transmitted by the remote transmit unit, wherein the base unit is configured to reproduce the sensor status signal from the transmit signals. The base unit may also produce a sensor status from the sensor status signal, and may display the sensor status.

In one embodiment, the remote input unit receives a first sensor output signal from a first sensor and a second sensor output signal from a second sensor. The first sensor may be an analog sensor, and the first sensor output signal may be an analog signal produced by the analog sensor in response to an input measurand (e.g., temperature, pressure, humidity, wind direction, wind velocity, and a level of collected rain water). The second sensor may be a digital sensor, and the second sensor output signal may be a digital signal produced by the digital sensor. The remote input unit produces the sensor status signal dependent upon the first and second sensor output signals such that: (i) the amount of time the sensor status signal remains in the first state is dependent upon the first sensor output signal, and (ii) an amount of time the sensor status signal remains in the second state is dependent upon the second sensor output signal.

A method for conveying sensor status information includes receiving a sensor output signal, and producing a sensor status signal depending upon the sensor output signal, wherein: (i) the sensor status signal alternates between a first state and a second state, and (ii) an amount of time the sensor status signal remains in the first state is dependent upon the analog sensor output signal. A transmit signal is broadcast each time the sensor status signal transitions between the first and second states, wherein the transmit signal includes direction information indicating the direction of the transition between the first and second states.

The receiving step may include receiving a first sensor output signal (e.g., an analog signal produced by an analog sensor) and a second sensor output signal (e.g., a digital signal produced by a digital sensor). The sensor status signal may be produced depending upon the first and second sensor output signals, wherein: (i) the amount of time the sensor status signal remains in the first state is dependent upon the first sensor output signal, and (ii) an amount of time the sensor status signal remains in the second state is dependent upon the second sensor output signal.

BRIEF DESCRIPTION OF THE DRAWINGS

Other objects and advantages of the invention will become apparent upon reading the following detailed description and upon reference to the accompanying drawings in which.

Figure 1:
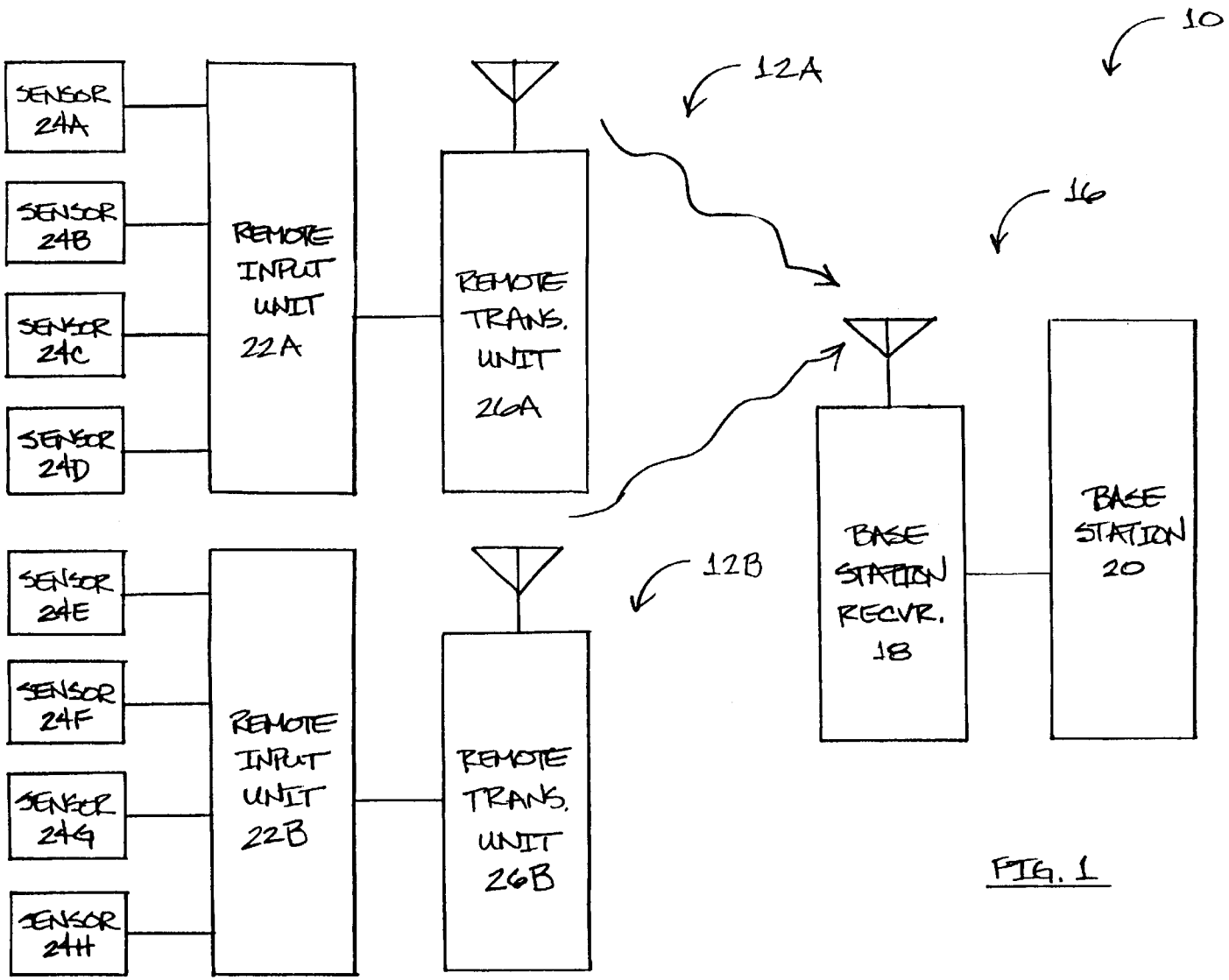
FIG. 1 is a bock diagram of one embodiment of a telemetry system including two remote units in radio communication with a base unit, wherein each remote unit includes a remote input unit coupled between a set of sensors and a remote transmit unit, and wherein the base unit includes a base station receiver coupled to a base station.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

FIG. 1 is a bock diagram of one embodiment of a telemetry system 10. Other embodiments of telemetry system 10 are contemplated. In the embodiment of FIG. 1, telemetry system 10 includes a first remote unit 12A and second remote unit 12B in radio communication with a base unit 16. Base unit 16 includes a base station receiver 18 coupled to a base station 20. First remote unit 12A includes a first remote input unit 22A coupled between a first set of four sensors 24A–24D and a first remote transmit unit 26A.

In the embodiment of FIG. 1, a single one of the first set of four sensors 24A–24D (e.g., sensor 24A) is an "analog" sensor producing an analog output signal (e.g., a voltage or a current) dependent upon an input measurand (e.g., voltage, current, temperature, pressure, humidity, etc.). Each of the remaining three sensors (e.g., sensors 24B–24D) are "digital" sensors, each producing a digital signal dependent upon a corresponding input measurand. For example, an output of a given one of the remaining three digital sensors may be in a first state (e.g., have a first value of voltage or current) when an input measurand is below a selected threshold value, and may be in a second state (e.g., have a second value of voltage or current) when the input measurand is above the threshold value. Alternately, the output of the given one of the remaining three digital sensors may be in the first state when a monitored door is in a closed position, and may be in the second state when the door is not in the closed position.

Remote input unit 22A receives the output signals produced by the four sensors 24A–24D as input signals. Remote input unit 22A produces a first sensor status signal as an output signal in a manner described below. The first sensor status signal alternates between a first state (e.g., a first value of voltage or current) and a second state (e.g., a second value of voltage or current) dependent upon the output signals produced by the four sensors 24A–24D. Remote transmit unit 26A receives the first sensor status signal as an input signal. Remote transmit unit 26A transmits a relatively short transmit signal to base station receiver 18 each time the first sensor status signal transitions between the first and second states.

Second remote unit 12B includes a second remote input unit 22B coupled between a second set of four sensors 24E–24H and a second remote transmit unit 26B. A single one of the four sensors 24E–24H (e.g., sensor 24E) produces an analog output signal dependent upon an input measurand. Each of the remaining three sensors (e.g., sensors 24F–24H) produces a digital signal dependent upon a corresponding input measurand. Remote input unit 22B receives the output signals produced by the four sensors 24E–24H as input signals. Remote input unit 22B produces a second sensor status signal as an output signal. The second sensor status signal alternates between the first and second states dependent upon the output signals produced by the four sensors 24E–24H. Remote transmit unit 26B receives the second sensor status signal as an input signal, and transmits a relatively short transmit signal to base station receiver 18 each time the second sensor status signal transitions between the first and second states.

Base station receiver 18 receives the transmit signals from remote transmit units 26A and 26B. In a manner described below, base station receiver 18 reproduces the first and second sensor status signals from the transmit signals. Base station receiver 18 provides the reproduced first and second sensor status signals to base station 20. As will be described in more detail below, base station 20 reproduces the output signals produced by the four sensors 24A–24D from the reproduced first sensor status signal, and reproduces the output signals produced by the four sensors 24E–24H from the reproduced second sensor status signal.

Figure 2:
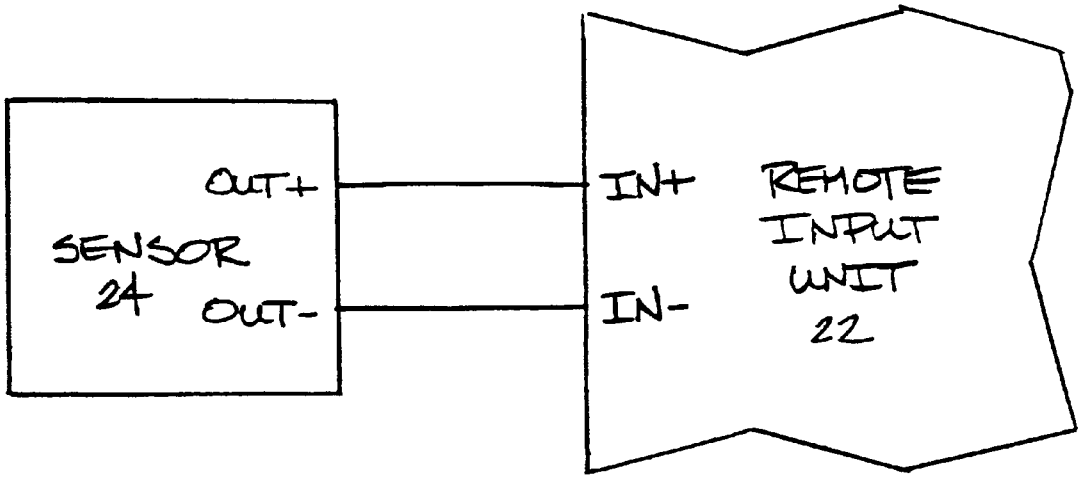
FIG. 2 is a bock diagram of one embodiment of a connection between one of the sensors and the corresponding remote input unit of FIG. 1.

FIG. 2 is a bock diagram of one embodiment of a connection between a sensor 24 and a remote input unit 22 of FIG. 1. As shown in FIG. 2, sensor 24 may have an Out+ terminal and an Out− terminal. The Out+ terminal may be coupled to an In+ terminal of remote input unit 22 via a first conductor (e.g., a wire), and the Out− terminal may be coupled to an In− terminal of remote input unit 22 via a second conductor. The first and second conductors may carry differential voltage signals, or a current signal (e.g., a 4–20 mA current loop). Alternately, the first conductor may carry a single-ended voltage signal, and the second conductor may be convey a ground electrical potential.

Figure 3:
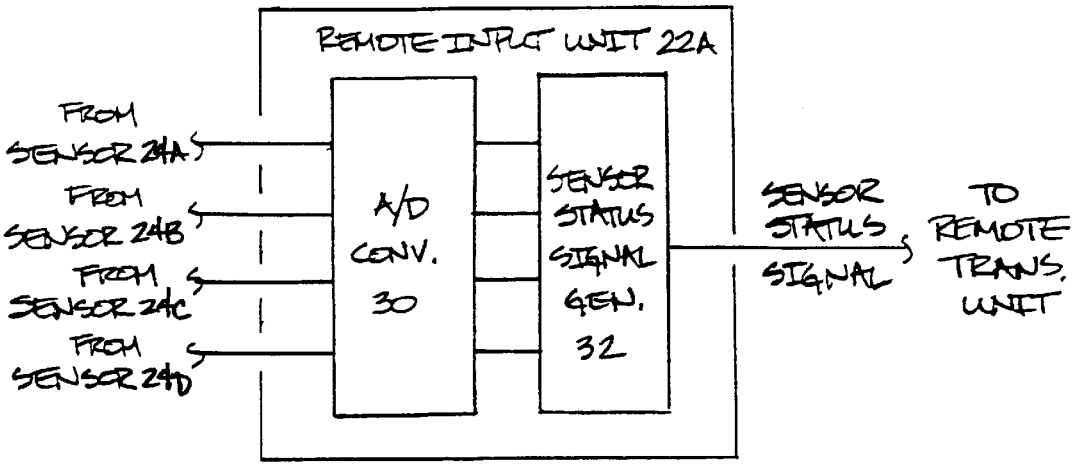
FIG. 3 is a bock diagram of one embodiment of the remote input units of FIG. 1.

FIG. 3 is a bock diagram of one embodiment of remote input unit 22A of FIG. 1. In the embodiment of FIG. 3, the remote input unit 22A includes an analog-to-digital (A/D) converter 30 coupled to a sensor status signal generator 32. A/D converter 30 receives input signals from sensors 24A–24D, and provides corresponding output signals to sensor status signal generator 32. A/D converter 30 receives the analog signal produced by the single analog sensor, digitizes the analog signal to produce a digital value dependent upon the analog signal, and provides the digital value to sensor status signal generator 32.

In the embodiment of FIG. 3, A/D converter 30 also receives the digital signals produced by the remaining digital sensors. The digital signals produced by the sensors may be voltage values. In this case, A/D converter 30 digitizes the voltage values to produce corresponding digital values dependent upon the voltage values, and provides the digital values to sensor status signal generator 32. Sensor status signal generator 32 receives the digital values derived from the signals produced by sensors 24A–24D and produces the first sensor status signal in a manner which will be described in more detail below. Remote input unit 22B of FIG. 1 is preferably configured similar to remote input unit 22A of FIGS. 1 and 3.

In other embodiments, A/D converter 30 may digitize the analog signal from the analog sensor and simply pass the digital signals produced by the remaining digital sensors directly to sensor status signal generator 32. Sensor status signal generator 32 may produce the first sensor status signal from the digital value of the analog sensor and the digital signals produced by the remaining digital sensors.

In still other embodiments, more than one of the sensors 24A–24D may be analog sensors. A/D converter 30 may digitize the analog signals from the multiple analog sensors, and may simply pass any digital signals produced by digital sensors directly to sensor status signal generator 32. Sensor status signal generator 32 may produce the first sensor status signal from the received digital values.

It is noted that remote input unit 22A may include signal conditioning circuitry coupled between sensors 24A–24D and A/D converter 30. Alternately, A/D converter 30 may include signal conditioning circuitry.

Figure 4:
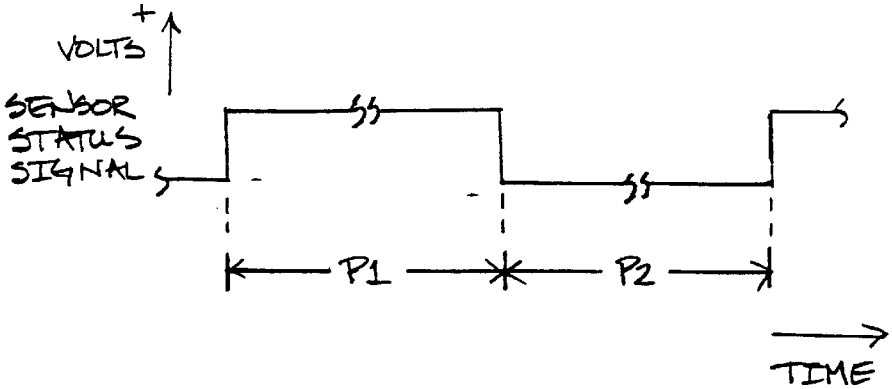
FIG. 4 is a diagram of an exemplary sensor status signal produced the remote input units of FIG. 1.

FIG. 4 is a diagram of an exemplary sensor status signal produced by one of the remote input units 22 of FIG. 1. In the embodiment of FIG. 4, the sensor status signal alternates between a first voltage value and a second voltage value dependent upon the output signals produced by sensors 24A–24D. The sensor status signal has the first voltage value during a first portion P1 of a period of the sensor status signal, and the second voltage value during a second portion P2 of the period of the sensor status signal. The length of the first portion P1 of the sensor status signal is dependent upon the digital value corresponding to the analog signal produced by the analog sensor coupled to the respective remote input unit 22. The length of the second portion P2 of the sensor status signal is dependent upon the digital values corresponding to the digital signals produced by the remaining three digital sensors coupled to the respective remote input unit 22.

For example, a magnitude of the analog signal produced by the analog sensor $AV_S$ may vary between a minimum analog value $AV_{MIN}$ and a maximum analog value $AV_{MAX}$. Similarly, the digital value corresponding to the analog signal produced by the analog sensor $DV_S$ may vary between a minimum digital value $DV_{MIN}$ and a maximum digital value $DV_{MAX}$. The length of the first portion P1 of the sensor status signal in time ($t_{P1}$) may depend upon $DV_S$ in the following manner:

$$t_{P1}=\{(t_{P1MAX}-t_{P1MIN})\cdot[(DV_S-DV_{MIN})/(DV_{MAX}-DV_{MIN})]\}+t_{P1MIN}$$

where $t_{P1MAX}$ is a selected maximum value of $t_{P1}$ and $t_{P1MIN}$ is a selected minimum value of $t_{P1}$. The selected value of $t_{P1MAX}$ may be, for example, 51 seconds, and the selected value of $t_{P1MIN}$ may be, for example, 1 second.

The length of the second portion P2 of the sensor status signal in time ($t_{P2}$) may depend upon the values of the digital signals produced by the remaining three digital sensors in the manner illustrated in Table 1 below:

TABLE 1

Exemplary Digital Sensor Output Values And Corresponding Values of $t_{P2}$.

| D1 | D2 | D3 | $t_{P2}$ (sec.) |
|---|---|---|---|
| 0 | 0 | 0 | 8.0 |
| 0 | 0 | 1 | 12.0 |
| 0 | 1 | 0 | 16.0 |
| 0 | 1 | 1 | 20.0 |
| 1 | 0 | 0 | 24.0 |
| 1 | 0 | 1 | 28.0 |
| 1 | 1 | 0 | 32.0 |
| 1 | 1 | 1 | 36.0 |

where D1 is the value of the digital signal produced by a first of the remaining three digital sensors, D2 is the value of the digital signal produced by a second of the remaining three digital sensors, and D3 is the value of the digital signal produced by the third of the remaining three digital sensors. It is noted that to arrive at the $t_{P2}$ values in Table 1 above, $t_{P2}$ values were selected to span a range from a selected minimum value of $t_{P2}$ ($t_{P2MIN}$=8.0 seconds) to a selected maximum value of $t_{P2}$ ($t_{P2MAX}$=36.0 seconds). Other values of $t_{P2MIN}$ and $t_{P2MAX}$ are possible, and selected $t_{P2}$ values may be arbitrarily assigned to combinations of D1, D2, and D3.

Figure 5:
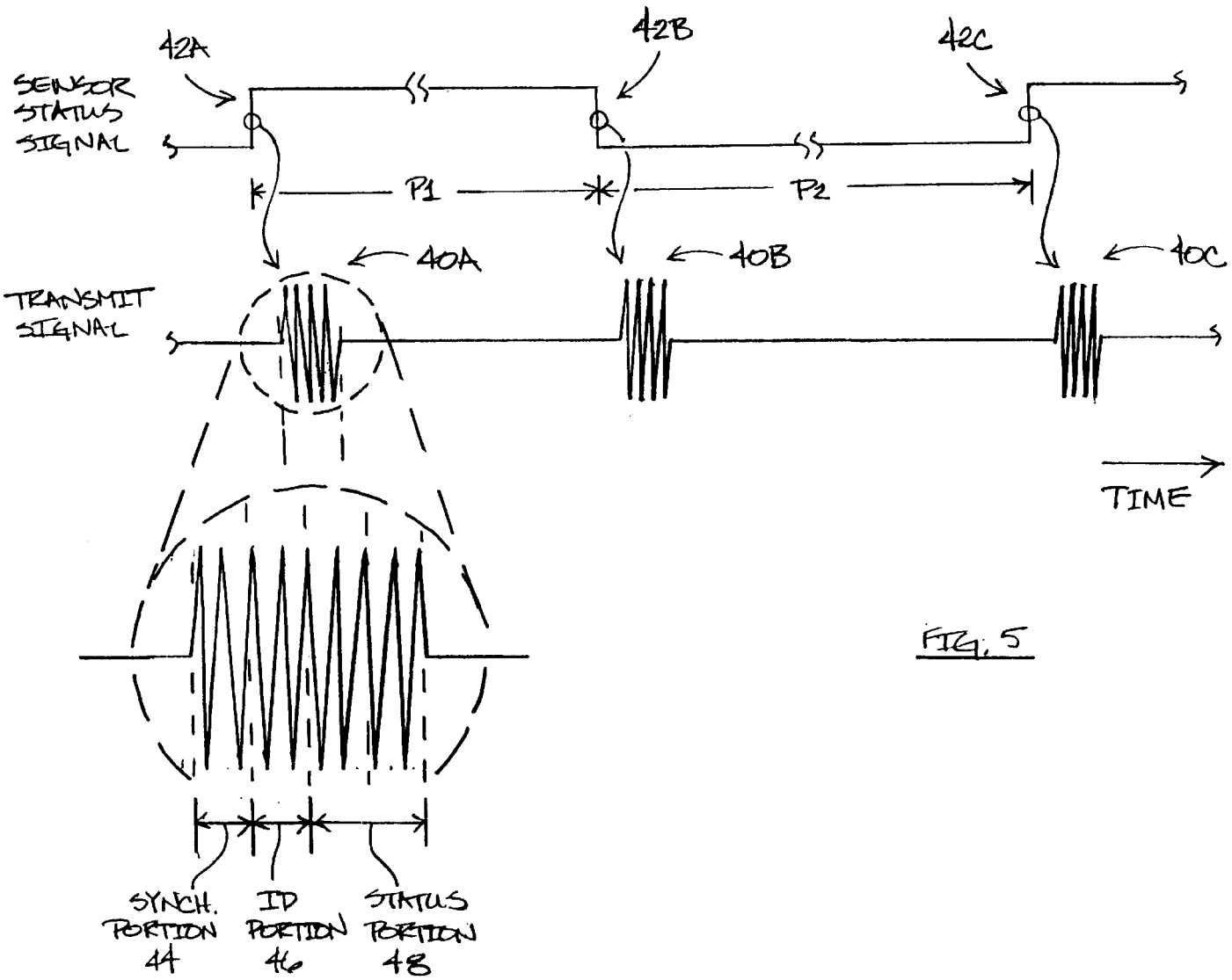
FIG. 5 is a diagram illustrating a correspondence between the sensor status signal of FIG. 4 and one embodiment of transmit signals produced by the associated remote transmit unit.

FIG. 5 is a diagram illustrating a correspondence between the sensor status signal of FIG. 4 and one embodiment of transmit signals 40 produced by the associated remote transmit unit 26. In the embodiment of FIG. 5, the remote transmit unit 26 responds to each transition of the sensor status signal between the first and second voltage values by transmitting a transmit signal 40. Each transmit signal 40 is a relatively short burst of radio frequency energy. Between transmit signals 40, the remote transmit unit 26 preferably does not transmit radio frequency energy (i.e., is preferably silent). In FIG. 5, a first transition 42A of the sensor status signal from the second voltage value to the first voltage value (i.e., a rising edge transition of the sensor status signal) causes the remote transmit unit 26 to transmit a first transmit signal 40A. A second transition 42B of the sensor status signal from the first voltage value to the second voltage value (i.e., a falling edge transition of the sensor status signal) causes the remote transmit unit 26 to transmit a second transmit signal 40B, and a third rising edge transition 42C of the sensor status signal causes the remote transmit unit 26 to transmit a third transmit signal 40C.

Each transmit signal 40 conveys information from the transmitting remote unit 12 to base unit 16, preferably by modulating a carrier frequency. The carrier frequency is preferably a frequency authorized by the Federal Communications Commission (FCC) for radio control (R/C) radio service communication (e.g., between 26.995 and 27.255 MHz). As indicated in FIG. 5, the amplitude of each transmit signal is preferably substantially constant.

In the embodiment of FIG. 5, each transmit signal 40 includes a synchronization portion 44, an identification (ID) portion 46, and a status portion 48. Synchronization portion 44 coveys one or more logic level transitions used to synchronize base station receiver 18 with the transmitting remote transmit unit 26. ID portion 46 follows synchronization portion 44, and conveys source identification information which uniquely identifies the transmitting remote unit 12 as the source of the transmit signal 40. The source identification information is preferably a series of binary digits (i.e., bits).

Status portion 48 follows ID portion 46, and conveys status information of the transmitting remote unit 12 to base unit 16. The status information preferably includes one or more bits having values dependent upon a direction of a transition of the sensor status signal which prompted transmission of the transmit signal. For example, in FIG. 5, status portion 48 of transmit signals 40A and 40C include a first set of one or more bits indicating that the sensor status signal transitioned from the second voltage value to the first voltage value. Status portion 48 of transmit signal 40B includes a second set of one or more bits indicating that the sensor status signal transitioned from the first voltage value to the second voltage value. Base station receiver 18 uses the first and second sets of one or more bits to recover the sensor status signal from the series of transmit signals 40. The status information may also include status information regarding other aspects of remote unit 12 (e.g., battery status, etc.).

It is noted that the source identification and status information may be conveyed at any time within the transmit period, and may also be conveyed using other modulation techniques such as amplitude or phase modulation.

Figure 6:
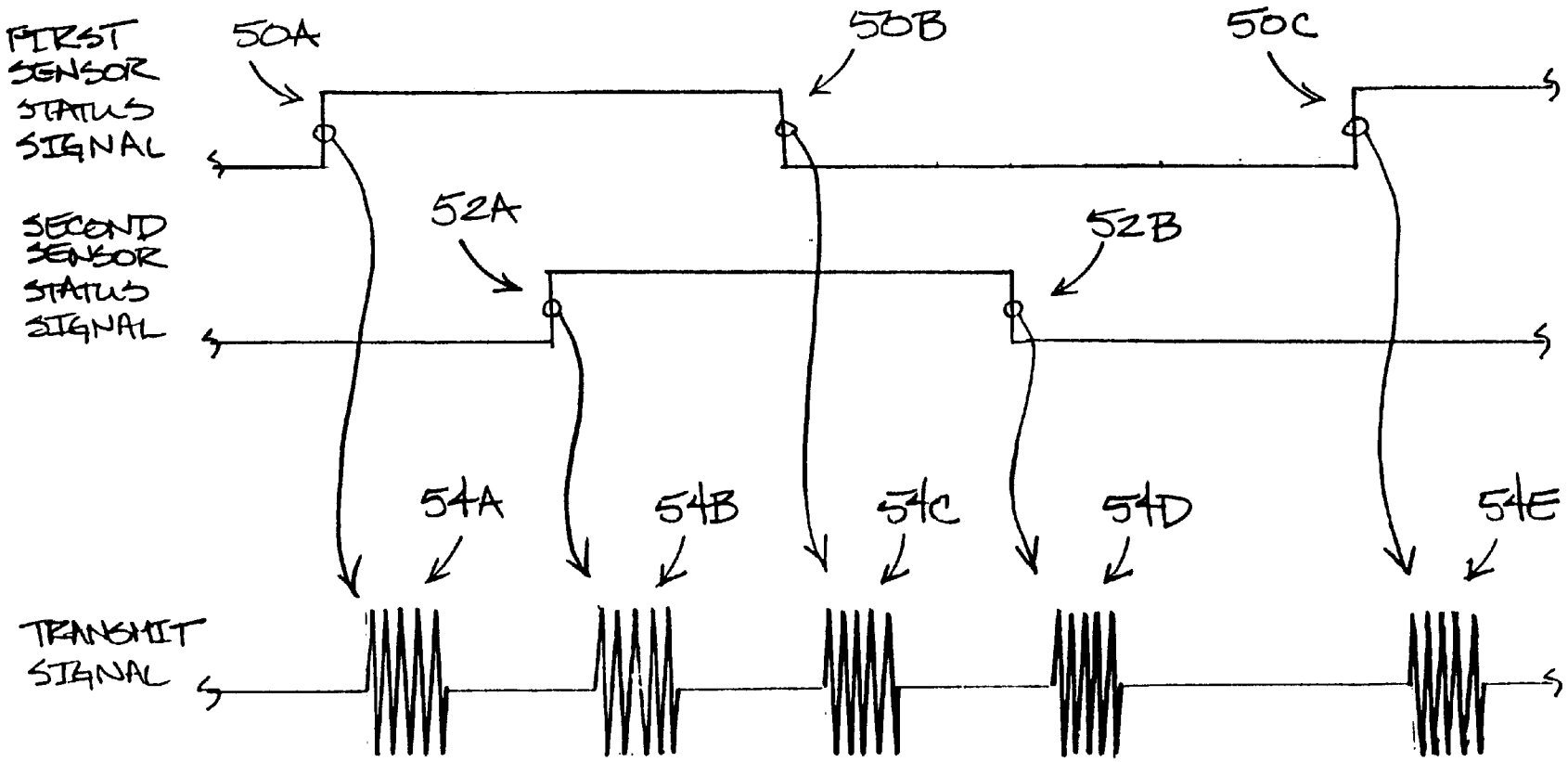
FIG. 6 is a diagram of one embodiment of the first and second sensor status signals produced by respective remote input units of FIG. 1 and a resultant series of transmit signals received by the base station receiver of FIG. 1.

FIG. 6 is a diagram of one embodiment of the first and second sensor status signals produced by respective remote input units 12A and 12B of FIG. 1 and a resultant series of transmit signals 40 received by base station receiver 18 of FIG. 1. In FIG. 6, a rising edge transition 50A of the first sensor status signal causes remote transmit unit 26A of remote unit 12A to transmit a first transmit signal 54A. A rising edge transition 52A of the second sensor status signal causes remote transmit unit 26B of remote unit 12B to transmit a second transmit signal 54B. A falling edge transition 50B of the first sensor status signal causes remote transmit unit 26A to transmit a third transmit signal 54C. A falling edge transition 52B of the second sensor status signal causes remote transmit unit 26B to transmit a fourth transmit signal 54D. A rising edge transition 50C of the first sensor status signal causes remote transmit unit 26A to transmit a fifth transmit signal 54E.

In FIG. 6, ID portion 46 of transmit signals 54A, 54C, and 54E identify remote unit 12A as the source. Status portion 48 of transmit signals 54A and 54E include the first set of one or more bits indicating that the sensor status signal transitioned from the second voltage value to the first voltage value. Status portion 48 of transmit signal 54C includes the second set of one or more bits indicating that the sensor status signal transitioned from the first voltage value to the second voltage value. As a result, base station receiver 18 is able to recover the first sensor status signal from transmit signals 54A, 54C, and 54E.

Similarly, ID portion 46 of transmit signals 54B and 54D identify remote unit 12B as the source. Status portion 48 of transmit signal 54B includes the first set of one or more bits indicating that the sensor status signal transitioned from the second voltage value to the first voltage value. Status portion 48 of transmit signal 54D includes the second set of one or more bits indicating that the sensor status signal transitioned from the first voltage value to the second voltage value. As a result, base station receiver 18 is able to recover the second sensor status signal from transmit signals 54B and 54D.

It is noted that remote transmit units 26A and 26B transmit radio signals at substantially the same frequency. Dependent upon the sensor status signals produced by remote input units 22A and 22B, it is possible for remote transmit units 26A and 26B to transmit simultaneously. Such "collisions" may result in the loss of data from one or both remote units 12.

Figure 7:
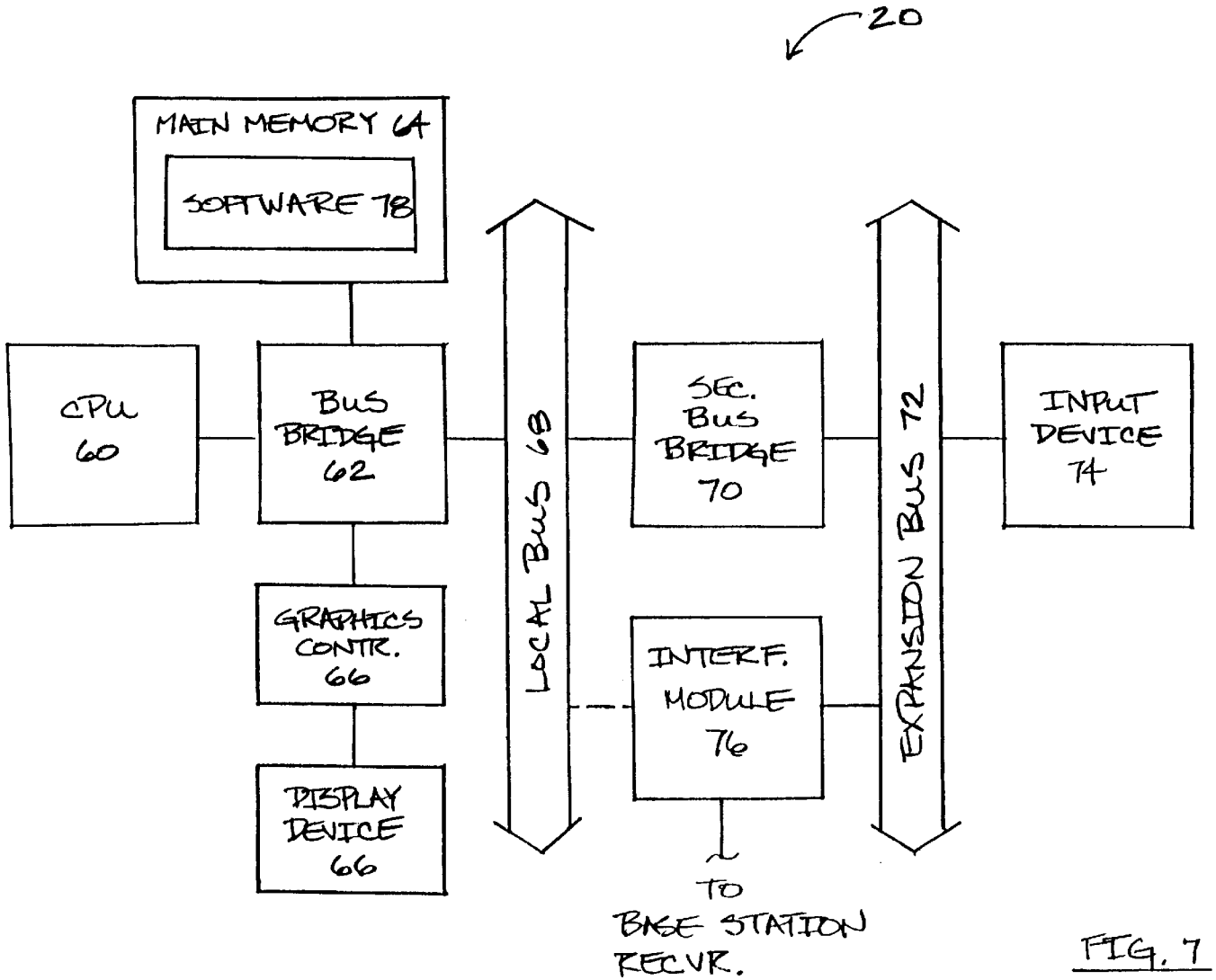
FIG. 7 is a bock diagram of one embodiment of the base station of FIG. 1, wherein the base station includes a main memory, ands wherein the main memory includes software.

FIG. 7 is a bock diagram of one embodiment of base station 20 of FIG. 1. In the embodiment of FIG. 7, base station 20 includes a central processing unit (CPU) coupled to a bus bridge 62. Bus bridge 62 is coupled to a main memory 64 and a graphics controller 66. Graphics controller 66 is coupled to a display device 66.

Bus bridge 62 is also coupled to a local bus 68. Local bus 68 may be, for example, a peripheral component interconnect (PCI) bus. A secondary bus bridge 70 is coupled between an expansion bus 72 and local bus 68. Expansion bus 72 may be, for example, an ISA/EISA bus. An input device 74 (e.g., a keyboard or mouse) is coupled to expansion bus 72.

In the embodiment of FIG. 7, base station 20 includes an interface module 76 coupled to expansion bus 72. Interface module 76 may be, for example, a card which fits into a connector coupled to expansion bus 72. As described above, base station receiver 18 provides the reproduced first and second sensor status signals to base station 20. Interface module 76 receives the reproduced first and second sensor status signals produced by base station receiver 18. As indicated in FIG. 7, interface module 76 may alternately be coupled to local bus 68. In this case, interface module 76 may be a card which fits into a connector coupled to local bus 68.

Figure 8:
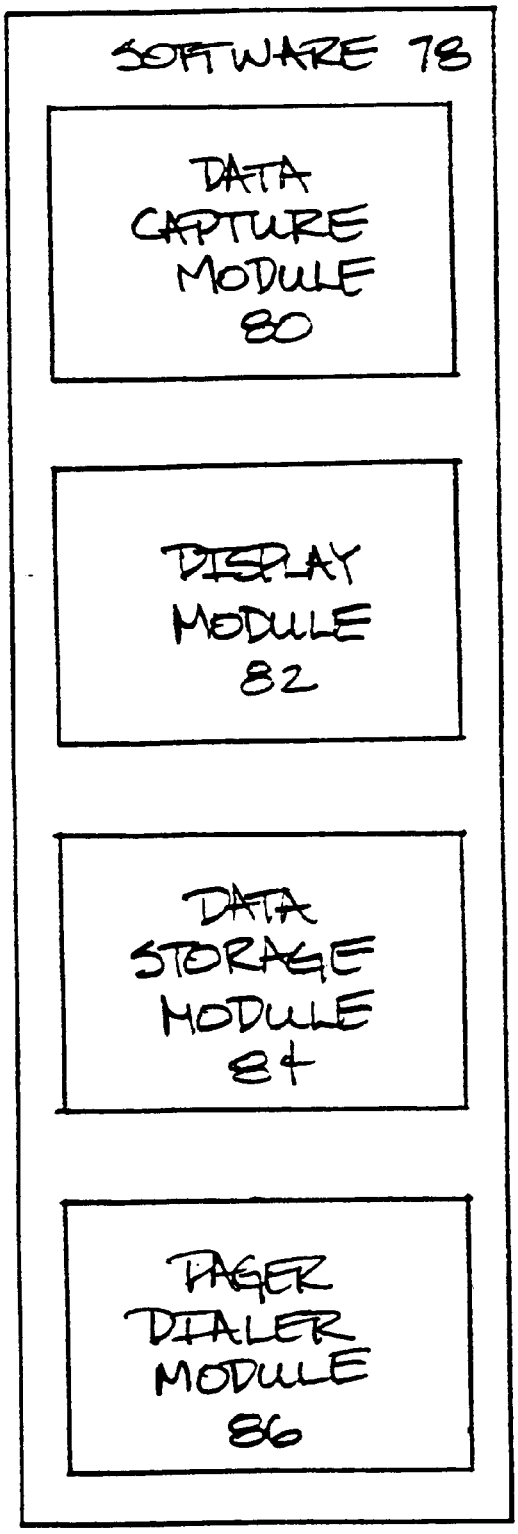
FIG. 8 is a block diagram of one embodiment of the software of FIG. 7, wherein the software includes a data capture module, a display module, a data storage module, and a pager dialer module.

In the embodiment of FIG. 7, base station 20 includes software 78 located within main memory 64. Software 78 obtains the reproduced first and second sensor status signals via interface module 76 and acts upon the reproduced first and second sensor status signals. FIG. 8 is a block diagram of one embodiment of software 78 of FIG. 7. In the embodiment of FIG. 8, software 78 includes a data capture module 80, a display module 82, a data storage module 84, and a pager dialer module 84. Data capture module 80 obtains the reproduced first and second sensor status signals via interface module 76. With regard to each reproduced sensor status signal, data capture module 70 converts a length of time between a rising edge transition and a subsequent falling edge transition to a value produced by the analog sensor of the corresponding remote unit 12 according to the relationship described above. Data capture module also converts a length of time between a falling edge transition of the sensor status signal and a subsequent rising edge transition to the digital values produced by the remaining sensors of the corresponding remote unit 12 according to the relationship described above. Data capture module 70 provides the values derived from the lengths of the time between edge transitions of the reproduced first and second sensor status signals to display module 82 and data storage module 84.

Data capture module 80 also compares the values derived from the lengths of the time between edge transitions of the reproduced first and second sensor status signals to selected threshold values. If one of the values exceeds a corresponding threshold value (analog sensor output signal) or is in an alarm state (digital sensor output signal), data capture module 80 activates pager dialer module 86.

Display module 84 receives the values derived from the lengths of the time between edge transitions of the reproduced first and second sensor status signals from a data capture module 80 and displays the values upon the display device of FIG. 7.

Data storage module 84 receives the values derived from the lengths of the time between edge transitions of the reproduced first and second sensor status signals from data capture module 80, and stores the data for future use.

Pager dialer module 86 is activated by data capture module 80. Base station 20 may be coupled to a telephone network. Once activated, pager dialer module 86 dials a pager number to alert a user that a value derived from the lengths of the time between edge transitions of the reproduced first and second sensor status signals exceeds a corresponding threshold value (analog sensor output signal) or is in an alarm state (digital sensor output signal).

Numerous variations and modifications will become apparent to those skilled in the art once the above disclosure is fully appreciated. It is intended that the following claims be interpreted to embrace all such variations and modifications.

What is claimed is:

1. A telemetry system, comprising:

a remote unit, including:

a remote input unit coupled to receive a sensor output signal and configured to produce a sensor status signal dependent upon the sensor output signal, wherein the sensor status signal alternates between a first state and a second state, wherein an amount of time the sensor status signal remains in the first state assumes a value within a predetermined range dependent upon the sensor output signal; and a remote transmit unit coupled to receive the sensor status signal and configured to transmit a transmit signal each time the sensor status signal transitions between the first and second states.

2. The telemetry system as recited in claim 1, wherein the sensor output signal is an analog signal produced by a sensor in response to an input measurand.

3. The telemetry system as recited in claim 1, wherein the input measurand is selected from the group consisting of temperature, pressure, humidity, wind speed, wind direction, and a level of collected rain water.

4. The telemetry system as recited in claim 1, wherein the transmit signal comprises a frequency modulated radio frequency carrier signal.

5. The telemetry system as recited in claim 1, wherein the transmit signal comprises a status portion, and wherein the status portion includes direction information indicative of a direction of the transition between the first and second states.

6. The telemetry system as recited in claim 5, wherein the transmit signal further comprises an identification portion including identification information uniquely identifying the remote unit.

7. The telemetry system as recited in claim 1, further comprising a base unit coupled to receive the transmit signals transmitted by the remote transmit unit and configured to reproduce the sensor status signal from the transmit signals.

8. The telemetry system as recited in claim 7, wherein the base unit is further configured to produce a sensor status from the sensor status signal and to display the sensor status.

9. A telemetry system, comprising:

a remote unit, including:

a remote input unit coupled to receive a sensor output signal and configured to produce a sensor status signal dependent upon the sensor output signal, wherein the sensor status signal alternates between a first state and a second state, wherein an amount of time the sensor status signal remains in the first state assumes a value within a predetermined range dependent upon the sensor output signal;

a remote transmit unit coupled to receive the sensor status signal and configured to transmit a transmit signal each time the sensor status signal transitions between the first and second states; and a base unit coupled to receive the transmit signals transmitted by the remote transmit unit and configured to reproduce the sensor status signal from the transmit signals, to produce a sensor status from the sensor status signal, and to display the sensor status.

10. The telemetry system as recited in claim 9, wherein the sensor output signal is an analog signal produced by a sensor in response to an input measurand.

11. The telemetry system as recited in claim 9, wherein the input measurand is selected from the group consisting of temperature, pressure, humidity, wind direction, wind velocity, and a level of collected rain water.

12. The telemetry system as recited in claim 9, wherein the transmit signal comprises a frequency modulated radio frequency carrier signal.

13. The telemetry system as recited in claim 9, wherein the transmit signal comprises a status portion, and wherein the status portion includes direction information indicative of a direction of the transition between the first and second states.

14. The telemetry system as recited in claim 13, wherein the transmit signal further comprises an identification portion including identification information uniquely identifying the remote unit.

15. A telemetry system, comprising:

a remote unit, including:

a remote input unit coupled to receive a first sensor output signal from a first sensor and a second sensor output signal from a second sensor, wherein the remote input unit is configured to produce a sensor status signal dependent upon the first and second sensor output signals, wherein the sensor status signal alternates between a first state and a second state, wherein an amount of time the sensor status signal remains in the first state is dependent upon the first sensor output signal, and wherein an amount of time the sensor status signal remains in the second state is dependent upon the second sensor output signal; and a remote transmit unit coupled to receive the sensor status signal and configured to transmit a transmit signal each time the sensor status signal transitions between the first and second states.

16. The telemetry system as recited in claim 15, wherein the first sensor is an analog sensor, and wherein the first sensor output signal is an analog signal produced by the first sensor in response to an input measurand.

17. The telemetry system as recited in claim 16, wherein the input measurand is selected from the group consisting of temperature, pressure, humidity, wind direction, wind velocity, and a level of collected rain water.

18. The telemetry system as recited in claim 16, wherein the second sensor is a digital sensor, and wherein the second sensor output signal is a digital signal produced by the second sensor.

19. The telemetry system as recited in claim 15, wherein the transmit signal comprises a frequency modulated radio frequency carrier signal.

20. The telemetry system as recited in claim 15, wherein the transmit signal comprises a status portion, and wherein the status portion includes direction information indicative of a direction of the transition between the first and second states.

21. The telemetry system as recited in claim 20, wherein the transmit signal further comprises an identification portion including identification information uniquely identifying the remote unit.

22. The telemetry system as recited in claim 15, further comprising a base unit coupled to receive the transmit signals transmitted by the remote transmit unit and configured to reproduce the sensor status signal from the transmit signals.

23. The telemetry system as recited in claim 22, wherein the base unit is further configured to produce a sensor status from the sensor status signal and to display the sensor status.

24. A telemetry system, comprising:

a remote unit, including:

a remote input unit coupled to receive an analog sensor output signal from an analog sensor and a digital sensor output signal from a digital sensor, wherein the remote input unit is configured to produce a sensor status signal dependent upon the analog and digital sensor output signals, wherein the sensor status signal alternates between a first state and a second state, wherein an amount of time the sensor status signal remains in the first state is dependent upon the analog sensor output signal, and wherein an amount of time the sensor status signal remains in the second state is dependent upon the digital sensor output signal; and a remote transmit unit coupled to receive the sensor status signal and configured to transmit a transmit signal each time the sensor status signal transitions between the first and second states.

25. A telemetry system, comprising:

a remote unit, including:

a remote input unit coupled to receive an analog sensor output signal from an analog sensor and a digital sensor output signal from a digital sensor, wherein the remote input unit is configured to produce a sensor status signal dependent upon the analog and digital sensor output signals, wherein the sensor status signal alternates between a first state and a second state, wherein an amount of time the sensor status signal remains in the first state is dependent upon the analog sensor output signal, and wherein an amount of time the sensor status signal remains in the second state is dependent upon the digital sensor output signal;

a remote transmit unit coupled to receive the sensor status signal and configured to transmit a transmit signal each time the sensor status signal transitions between the first and second states; and a base unit coupled to receive the transmit signals transmitted by the remote transmit unit and configured to reproduce the sensor status signal from the transmit signals, to produce a sensor status from the sensor status signal, and to display the sensor status.

26. A method for conveying sensor status information, comprising:

receiving a sensor output signal;

producing a sensor status signal depending upon the sensor output signal, wherein the sensor status signal alternates between a first state and a second state, wherein an amount of time the sensor status signal remains in the first state assumes a value within a predetermined range dependent upon the sensor output signal; and broadcasting a transmit signal each time the sensor status signal transitions between the first and second states, wherein the transmit signal includes direction information indicative of a direction of the transition between the first and second states.

27. The method as recited in claim 26, wherein the receiving step comprises receiving a first sensor output signal and a second sensor output signal, and wherein the producing step comprises producing the sensor status signal such that: (i) the amount of time the sensor status signal remains in the first state is dependent upon the first sensor output signal, and (ii) an amount of time the sensor status signal remains in the second state is dependent upon the second sensor output signal.

28. A method for conveying sensor status information, comprising:

receiving an analog sensor output signal and a digital sensor output signal;

producing a sensor status signal depending upon the analog and digital sensor output signals, wherein the sensor status signal alternates between a first state and a second state, wherein an amount of time the sensor status signal remains in the first state is dependent upon the analog sensor output signal, and wherein an amount of time the sensor status signal remains in the second state is dependent upon the digital sensor output signal; and broadcasting a transmit signal each time the sensor status signal transitions between the first and second states, wherein the transmit signal includes direction information indicative of a direction of the transition between the first and second states.

* * * * *